United States Patent [19]

Wich

[11] Patent Number: 4,838,232

[45] Date of Patent: Jun. 13, 1989

[54] FUEL DELIVERY CONTROL SYSTEM

[75] Inventor: Thomas J. Wich, Springfield, Mass.

[73] Assignee: AIL Corporation, Columbia, S.C.

[21] Appl. No.: 125,740

[22] Filed: Nov. 30, 1987

Related U.S. Application Data

[63] Continuation of Ser. No. 15,495, Feb. 5, 1987, abandoned, which is a continuation of Ser. No. 640,640, Aug. 14, 1984, abandoned.

[51] Int. Cl.[4] ..... F02M 39/00

[52] U.S. Cl. ..... 123/506; 123/458; 123/300

[58] Field of Search ..... 123/299, 300, 506, 458, 123/500, 501, 503, 468, 467

[56] References Cited

U.S. PATENT DOCUMENTS

| | | | |
|---|---|---|---|
| 3,690,768 | 9/1972 | Nagasawa | 123/300 |
| 3,742,918 | 7/1973 | Murtin | 123/458 |
| 3,835,829 | 9/1974 | Links | 123/458 |
| 4,258,674 | 3/1981 | Wolff | 123/446 |

FOREIGN PATENT DOCUMENTS

| | | | |
|---|---|---|---|
| 1103079 | 3/1961 | Fed. Rep. of Germany | 123/300 |

OTHER PUBLICATIONS

SAE Technical Paper Series 840272 entitled "Two Novel Diesel Injection Systems", by W. F. Ball, Presented International Congress & Exposition, Detroit, MI, Feb. 27–Mar. 2, 1984.

Proc. ISATA Conference, Cologne, 1983, vol. 1, pp. 225–244, entitled "Charge Stratification and Lean Mixture Combustion Systems in Two-Stroke Otto Cycle Engines by Means of Electronically Controlled Pressure Impact Injection", by Prof. V. Kuntscher.

*Primary Examiner*—Carl S. Miller

*Attorney, Agent, or Firm*—Richard D. Weber

[57] ABSTRACT

A system for controlling delivery of fuel to a compression ignition engine having a predetermined characteristic ignition delay. A positive-displacement pump, typically a high-pressure, multiplunger in-line pump, receives fuel from a source and provides intermittent, pressurized pulses of fuel flow. A conduit extends from a pumping chamber to a node to which a normally-closed fuel injector is operatively connected. A normally-open, solenoid-controlled bypass valve has an inlet port connected to the conduit node for allowing fuel to bypass the injector. When a signal is applied to the bypass valve it rapidly closes, causing the pressure at the injector to rapidly increase to a first injector-opening level to inject pilot fuel. Thereafter, following a predetermined hydraulic delay, the pressure at the injector rapidly increases to a second level greater than the first to provide main fuel injection. The conduit length determines the hydraulic delay and is selected to have a predetermined time relation with the engine's ignition delay time. The hydraulic delay substantially corresponds with the ignition delay time in the preferred embodiment. The bypass valve also responds rapidly in the closing direction. Part of the make-up fuel delivered by the pump is provided by reverse flow of fuel through the open bypass valve.

14 Claims, 5 Drawing Sheets

FUEL DELIVERY CONTROL SYSTEM

This is a continuation of co-pending application Ser. No. 015,495 filed on Feb. 5, 1987, which is a continuation of application Ser. No. 640,640, filed Aug. 14, 1984, both now abandoned.

DESCRIPTION

1. Technical Field

The invention relates to a fuel supply control system and more particularly to a fuel supply control system for use with compression-ignition engines. More particularly still, the invention is concerned with a solenoid-valve controlled fuel delivery system for a compression-ignition engine.

2. Background Art

In the delivery and control of fuel to compression-ignition, or diesel engines, it has been conventional for a single or multi-cylinder positive displacement pump to provide intermittent pulses of fuel flow to one or more respective fuel injectors associated with respective cylinders of the compression-ignition engine. Two major variables in the delivery of fuel to such engines include the timing of the start of fuel injection and the duration or quantity of the fuel injected to each cylinder. In most of the conventional pumps, and particularly those multi-cylinder, in-line fuel pumps capable of providing the pulses of fuel at high pressure (i.e., in excess of 10,000 psi) to direct injection (DI) engines, control of the timing and fuel quantity has been effected by use of a helix associated with the pumping piston and actuated by a rack assembly. Additional adjustment to the start of injection timing is provided by adjustment of the timing cam. The provision of these timing and quantity control capabilities in such pumps contributes substantially to their complexity, weight and cost.

In recent years various fuel delivery systems for diesel engines have been disclosed in which the mechanical timing and quantity controls for the pump may be simplified or eliminated by replacing their function with a solenoid-controlled valve. One example of such system is illustrated in U.S. Pat. No. 3,851,635 to Murtin et al. In that patent there is illustrated and described a fuel supply system employing a simplified pump for providing intermittent pulses of pressurized fuel flow which, under the control of a solenoid actuated valve, either bypass a fuel injector or are applied to the injector such that it is caused to open and the fuel injected into the engine. The solenoid-controlled valve is normally open and is closed at the time fuel injection is to begin and remains closed for the interval during which fuel is to be injected. The precise positioning of the solenoid control bypass valve in the conduit between the pump and the injector does not appear to be critical so long as its closure results in the opening of a respective fuel injector.

A more recent disclosure of a solenoid-valve controlled fuel injection system is contained in U.S. Pat. No. 4,258,674 to Wolff. That patent discloses a fuel injection system in which a simplified pump provides intermittent pulses of pressurized fuel flow to a fuel injector valve which includes a solenoid-actuated servo valve for controlling the timing and duration of fuel injection. The servo valve associated with a fuel injector is normally in a first position which serves to provide a balancing pressure to a pair of oppositely disposed pressure surfaces on the fuel injector valve.

When the servo valve is actuated to its second position, the fluid pressure balance is removed from the fuel injection valve and it is allowed to open in reponse to one pressure being greater. Futher, that patent discloses a hydraulic situation by which the fluid pressure pulse initiated by the closing of a pumping port reverberates in the conduit between the pump and the closed servo valve and injector valve to create a standing wave of magnified pressure. When the solenoid is actuated to its second position to open the servo valve and allow fuel injection, the resulting pressure at the fuel injection valve is seen to be somewhat greater than that provided by the pump alone. This phenomenon is said to be speed-dependent inasmuch as the number of reverberations of the pressure pulse in the conduit is greater at low speeds than at high speeds.

DISCLOSURE OF INVENTION

Because the combustion process in a diesel engine is compression-ignited, a certain delay exists between the instant when fuel is first injected and the instant when combustion of that fuel actually begins. This delay is typically known as ignition delay. For any particular type of diesel engine there exists a characteristic ignition delay which may be predetermined empirically. Further, it is desirable to avoid the sudden injection of the entire quantity of fuel to be combusted as it results in excessive pressure rise causing noise and stress on engine parts and possibly an increse in $NO_x$.

Accordingly, it may be desirable to first inject a relatively small quantity of fuel, known as a pilot injection, followed by the main fuel injection. If the interval between the start of the pilot injection and the start of the main fuel injection approximately corresponds to the engine's characteristic ignition delay, the combustion process is enhanced or optimized inasmuch as the main fuel is injected just as the pilot fuel is beginning to combust. A desirable programming of fuel injection to include pilot injection is one which schedules the main fuel injection to occur a predetermined interval after the pilot injection, which interval is substantially the equivalent of the ignition delay.

Accordingly it is a principal object of the present invention to provide an improved system for the delivery of fuel to a compression-ignition engine. Included within this object is the provision of a fueling system which delivers both a pilot injection and a main injection of fuel to the engine.

It is a further object of the present invention to provide a fueling system for a compression-ignition engine, which fueling system inherently provides a predetermined delay between the start of a pilot injection and the start of the following main fuel injection. Included within this object is the provision of such delay such that it substantially corresponds with the characteristic ignition delay of a particular engine.

It is a still further object of the present invention to provide an improved fueling system utilizing an intermittent or jerk-type pump capable of delivering relatively high pressures to a direct injection compression-ignition engine. Included within this object is the provision of such pump having a simplified and economical, mechanical design.

The present invention provides a system for controlling delivery of fuel to a compression ignition engine, which engine has a predetermined characteristic ignition delay. A positive-displacement pump, typically a multiplinger in-line pump, receives fuel from a source and provides intermittent, pressurized pulses of fuel flow. A conduit extends from a pumping chamber to a node to which a normally-closed fuel injector is operatively connected. A normally-open, solenoid-controlled bypass valve has an inlet port connected to the conduit node for allowing fuel to bypass the injector. When a signal is applied to the bypass valve it rapidly closes, causing the pressure at the injector to rapidly increase to a first injector-opening level to inject pilot fuel. Thereafter, following a predetermined hydraulic delay, the pressure at the injector rapidly increases to a second level greater than the first to provide main fuel injection. The length of the conduit determines the hydraulic delay and is selected to have a predetermined time relation with the engine's ignition delay time. The hydraulic delay substantially corresponds with the ignition delay time in the preferred embodiment.

The bypass valve responds rapidly in both the opening and closing directions, and the initiation and duration of the control signal are adjustable during operation.

Part of the make-up fuel delivered by the pump is provided by reverse flow of fuel through the open bypass valve.

BEST MODE FOR CARRYING OUT THE INVENTION

Figure 1:
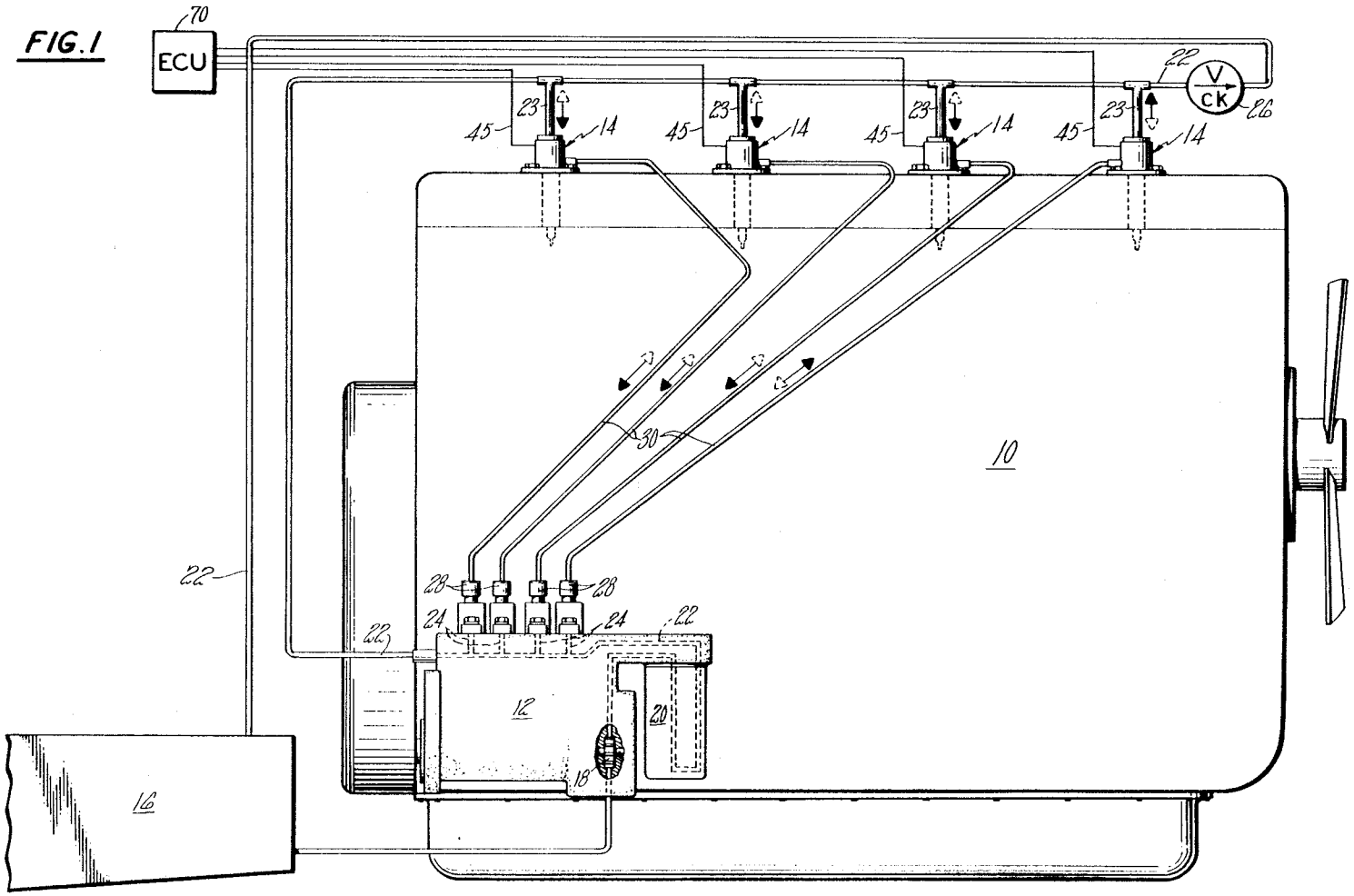
FIG. 1 is a generalized schematic view of the complete fuel system of a four-cylinder engine embodying the invention.

Referring to FIG. 1 there is schematically illustrated a fuel delivery system for a compression-ignition or diesel engine 10 in accordance with the invention. For purposes of describing the invention, the engine 10 will be presumed to be a four-cylinder, naturally aspirated, medium duty diesel engine having a displacement of approximately one liter per cylinder. Correspondingly, a relatively high pressure, four-cylinder, in-line fuel pump 12 is driven by engine 10 for providing intermittent or periodic pulses of fuel flow to respective bypass valve and injector assemblies 14. The pump 12 is capable of delivering fuel pulse pressures as great as about 15,000 psi (approximately 1,000 bar) for direct injection. It will be understood that the fuel delivery system of the invention may be used with diesel engines of numerous different configurations and that the pump 12 might alternatively be constituted of individual unit pumps each incorporated with the engine.

Fuel is drawn from a source, such as fuel tank 16, by a supply pump 18. Supply pump 18 is of the continuously operating type and may be associated with pump 12 in a known manner or may exist as a stand-alone pump which is driven electrically or by a mechanical takeoff from the engine 10 or the pump 12. The supply pump 18 provides a continuous supply of fuel at a relatively low pressure of about 45 psi (3 bar). The output of supply pump 18 is passed through a filter 20 whereupon it enters a low pressure supply conduit 22. The low pressure supply conduit 22 may also serve in some instances to provide a drain, as will be hereinafter described. The low pressure supply conduit 22 extends, as represented by branches 24, to each of the four pumping cylinders within the in-line pump 12. The low pressure supply conduit 22 also includes separate branches 23 extending to each of the respective injector assemblies 14. Finally, the supply conduit 22 returns to the fuel tank 16 via a low pressure check valve or orifice 26.

Each cylinder of the pump 12 includes a respective outlet 28 which forms one end of a respective fuel conduit 30. Each fuel conduit 30 is suited for the delivery of high pressure pulses of fuel to respective injector assemblies 14. Importantly to the invention, each fuel conduit 30 is of a predetermined length selected to provide a requisite hydraulic delay between the start of a pilot pulse and the start of the main fuel pulse, which delay is intended to correspond with the engine's characteristic ignition delay, as will be hereinafter described in greater detail.

Figure 2:
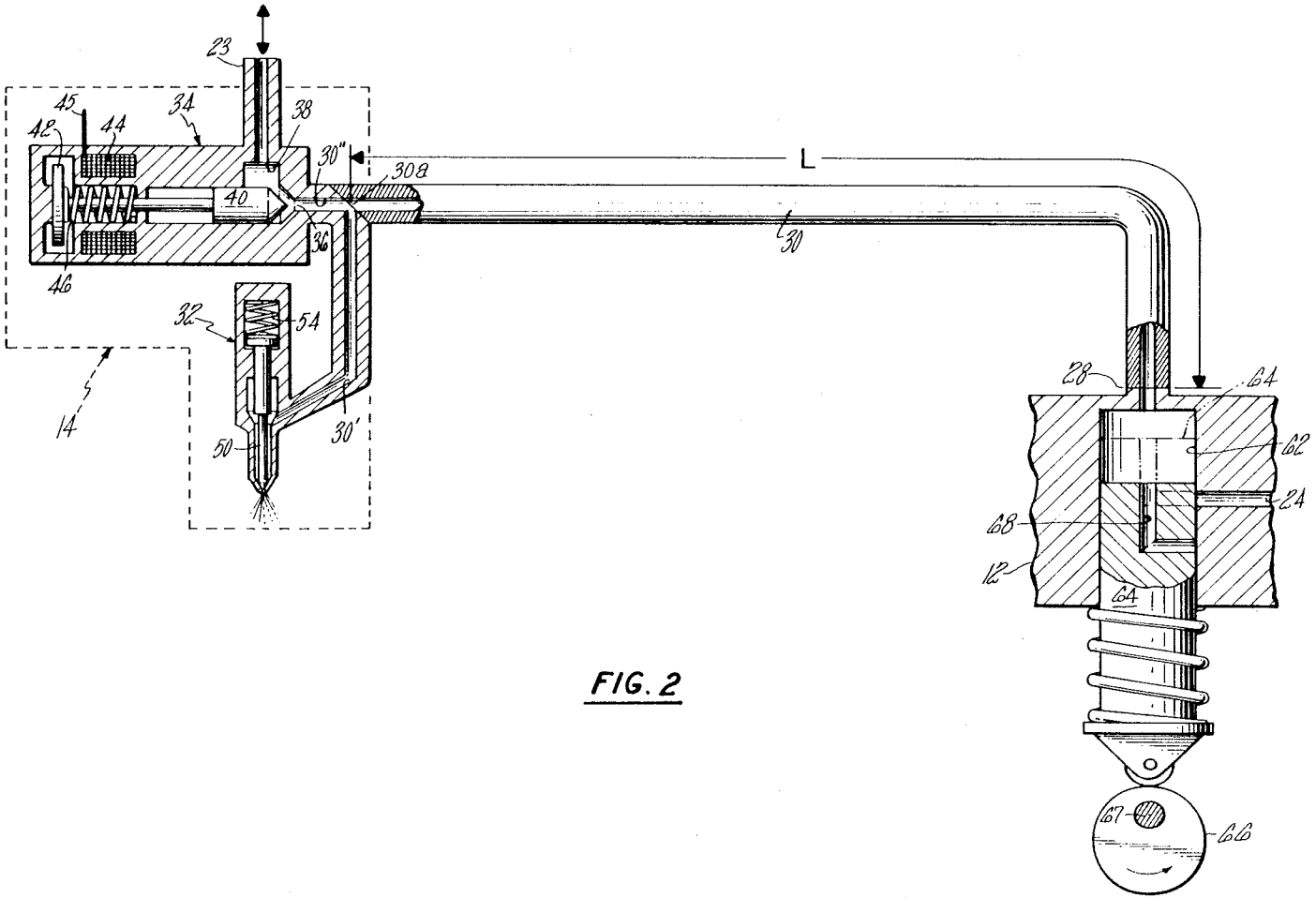
FIG. 2 is a functional schematic illustration of the fuel supply system of the invention in a simplified form.
Figure 3:
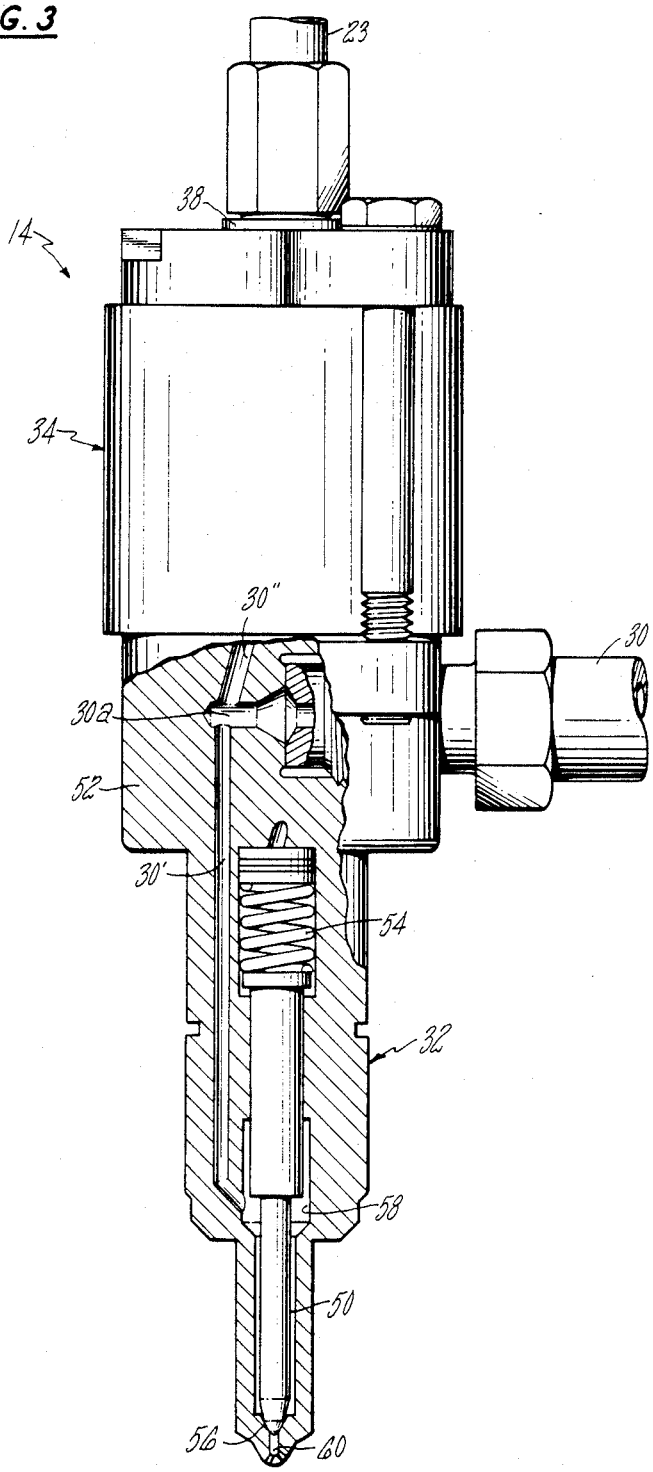
FIG. 3 is a sectional view of a fuel injector valve including a solenoid-actuated bypass valve in accordance with the present invention.

Referring to FIGS. 1, 2 and 3 each bypass valve and injector assembly 14 is depicted as including an injector nozzle 32 and a bypass valve 34. Although the injector 32 and the bypass valve 34 may be housed separately as depicted in FIG. 2 for diagrammatic illustration, they may also be and preferably are, located in a common housing as illustrated in FIG. 3. Each bypass valve 34 includes a pair of ports 36 and 38, with port 36 being connected directly to high pressure conduit 30 and port 38 being connected to the low pressure supply branch conduit 23. The bypass valve 34 includes a valve element 40 joined with an armature 42 for electromagnetic actuation by energization of the coil 44 of a solenoid. The solenoid coil 44 is energized by a signal current applied thereto on a pair of wires represented by a single line 45. The solenoid-actuated bypass valve 40 is in a normally-open condition, as symbolically represented in FIG. 2 by the existence of a spring 46. Energization of coil 44 by the application of an appropriate signal on line 45 serves to rapidly close the bypass valve 34 and conversely, an appropriate signal, such as the cessation of electrical current, allows the valve to rapidly reopen.

The fuel injection nozzle 32 includes a needle valve element 50 contained within nozzle body 52 and biased by spring 54 into valve-closing engagement with a valve seat 56. When the fuel pressure within chamber 58 is sufficient to overcome the biasing force of spring 54, the needle 50 lifts from seat 56 in a known manner to inject fuel directly into the engine via nozzle orifice 60. The fuel which serves both to open the injector valve 50 and to supply fuel to the engine 10 is supplied to injector chamber 58 via an extension 30' of the high pressure fluid conduit 30.

FIG. 2 diagrammatically illustrates one of the pumping chambers 62 in the in-line pump 12 which serves as the source of pressurized pulses of fuel flow through a respective conduit 30. A piston or plunger 64 reciprocates within the pumping chamber 62 to provide the pressurized pulses of fuel flow. Reciprocation of each plunger 64 is effected by a cam 66 mounted on a shaft 67 and driven directly or indirectly by the engine 10. Pump 12 may for the most part be of a type which is commercially available from any of several pump manufacturers; however, such pump must be modified since the control racks, control mechanisms for control of the pump output and pump delivery valves are not necessary. Additionally, no provision need be made for adjusting the timing of cam 66 during operation. Plunger 64 is depicted at the bottom of its operating stroke, illustrating that the port to the conduit 24 associated with the low pressure supply remains covered. As the plunger 64 is driven upward by the cam 66 it forces fuel contained in pumping chamber 62 out through high pressure conduit 30 for bypass through the bypass valve 34 or for injection through injector 32, as will be hereinafter described. As the plunger 64 nears the top of its stroke, a venting bore 68 formed therein moves into registry with the supply conduit 24, as illustrated in dotted line, to allow fuel to flow in either direction.

When plunger 64 is at the top of its stroke, the registry of venting bore 68 with supply conduit 24 ensures that the small remaining volume of pumping chamber 62 is completely filled with fuel to begin an intake stroke. On the downward stroke of the plunger 64 the venting bore 68 will move out of registry with conduit 24 and thus create a suction within the pumping chamber 62. In accordance with an aspect of the invention, the pumping chamber 62 is not provided with a delivery valve at its outlet and the bypass valve 34 will be open at this stage of operation such that fuel is allowed to flow reversely through a respective low pressure supply branch 23 and reversely through a respective high pressure conduit 30, thereby ensuring a full charge of fuel in the respective pumping chamber 62 when the plunger 64 reaches the bottom of its stroke. Typically, most of the fuel charge in pumping chamber 62 (i.e., 75–85%) will be supplied by such reverse flow in conduit 30. Solid and broken-line arrowheads have been used in conduit branches 23 of FIG. 1 to illustrate the possible flow in either direction in each, with any three flowing in the reverse direction while one flows in the forward direction.

The general timing of the initiation and termination of fuel injection to engine 10 is determined by the electronic control unit 70 which provides control signals via respective lines 45 to the respective bypass valves 34. Generally speaking, the electronic control unit 70 will respond to sensed engine operating parameters such as speed, load, temperature and the like to provide control signals in accordance with a predetermined control program. Inasmuch as each bypass control valve 34 is normally open, the control afforded by electrical signals on lines 45 normally involves the closing of the valve 34 by energization of coil 44 and the reopening of the valve by discontinuing such energization of the coil. During the time a bypass valve 34 is open, fuel flow may occur in either direction past the valve through branch conduit 23 and high pressure conduit 30. The capacities of branch conduits 23 and high pressure conduits 30 are such that the pressure of fuel flowing therein when bypass valve 34 is open is relatively low even though a pumping plunger 64 is in its upward stroke. Accordingly, the fuel pressure appearing in extension conduit 30' to a respective injector 32 is normally below the threshold level required to overcome the bias of spring 54 for opening the injector.

However, if bypass valve 34 is closed and the plunger 64 is in its upward stroke, the pressure of the fuel in conduit 30 and extension 30' will increase and will overcome the bias of injector spring 54 to allow injection of fuel into the engine. Absent a consideration of the flow dynamics occassioned by a sudden closing of the bypass valve 34, the fuel pressure in conduit 30 would be determined by the stroke of plunger 64 which is controlled by the profile of cam 66. That pressure increases during the plunger's upward stroke, the rate of increase moderating somewhat when the injector 32 opens.

In accordance with the invention the rapid closing of bypass valve 34 during the pumping stroke of a respective plunger 64 operates to immediately stop the flow of fuel at the inlet port 36 to the bypass valve, which results in a rapid and significant rise in the pressure of the fuel in that region. This phenomenon in water pipes is known as "water hammer" and for the purposes of the present invention, is referred to as "fuel hammer". This rapid increase in the fuel pressure in conduit 30 occurs most immediately in the region of bypass valve inlet port 36, and thus also soon thereafter in the region of injector 32 inasmuch as the conduit extension 30' is relatively short compared to the overall length of conduit 30 and is in general proximity with the inlet poort 36 of the bypass valve. This rapid pressure increase is such that the opening bias in injector 32 is overcome and injection of fuel into engine 10 begins.

Further in accordance with the invention, the rapid rise in the pressure of the fuel in conduit 30 at bypass valve 34 travels the short distance of any conduit extension 30'' to the node or junction $30_a$ at which conduit extension 30' joins conduit 30, and then travels back along conduit 30 to the outlet 28 and pumping chamber 62 of pump 12, whereupon it is reflected back along conduit 30 toward the injector 32. Because the closure of bypass valve 34 occurs during the compression stroke of plunger 64, the pressure traces depicted in FIG. 5 result.

Figure 5:
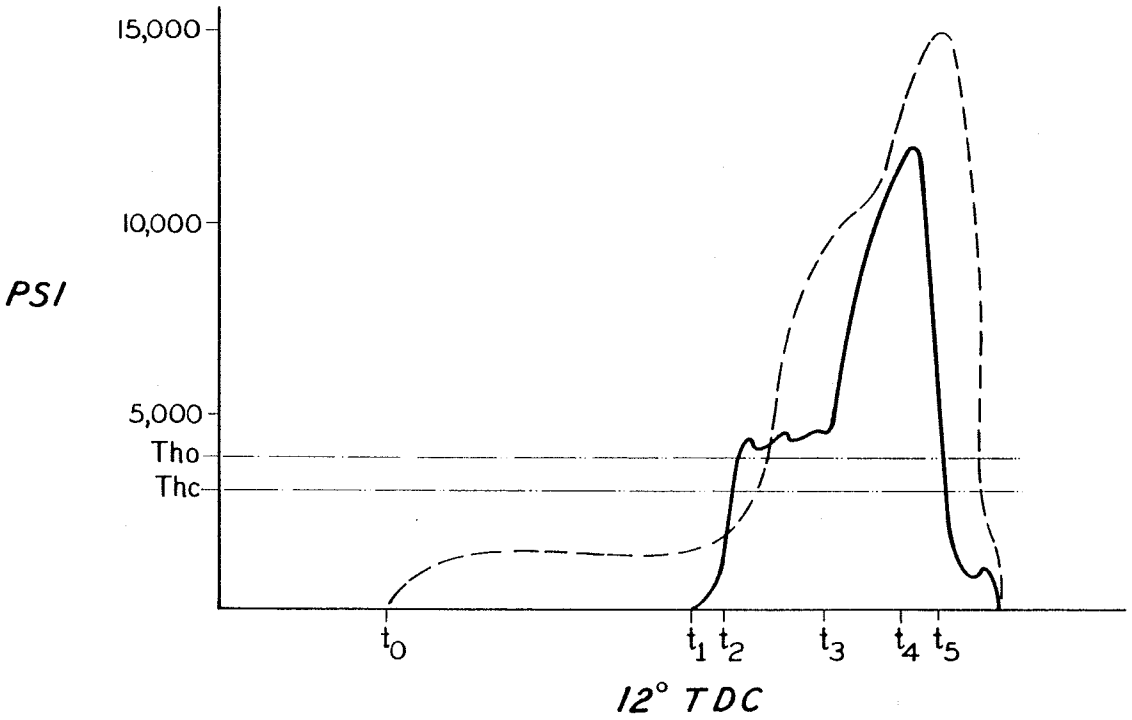
FIG. 5 is a diagram illustrating the fuel pressure at the injector and the fuel pressure at the pump each as a function of crank angle.

Referring to FIG. 5, the pressure at the outlet 28 of a pumping chamber 62 of pump 12 is illustrated in dotted line as a function of time. It will be appreciated that the scale of the X-axis might alternatively have been crank angle or pump cam angle at some engine operating condition, however a time base more appropriately illustrates the principles of the invention.

The solid line trace in FIG. 5 depicts the pressure of fuel in conduit 30' at the injector 32. The pressure at pump 12 increases very gradually between $t_0$ and $t_1$ as the plunger 64 begins its compression stroke and the bypass valve 34 remains open. At time $t_1$ a control signal is applied to line 45 and the bypass valve 34 rapidly closes. The fuel pressure in conduit 30' at the fuel injector 32, and specifically in chamber 58 of the injector, rapidly increases from less than 1,000 psi to a level at $t_2$ which exceeds the opening threshold pressure, $Th_o$. The delay between $t_1$ and $t_2$ is determined mainly by the response time of the bypass valve 34 plus a hydraulic delay proportional to the length of conduit 30'. Typically conduit 30' will be relatively short. In the present embodiment the pressure at which injector 32 opens is approximately 4,000 psi and this initial fuel pressure pulse may have a pressure of about 5,000 psi. Then, both because the needle 50 of the fuel injector 32 has opened and because the pressure pulse is moving upstream along conduit 30 while the pumping plunger 64 is continuing its upward stroke, there is relatively little change in the fuel pressure in conduit 30' at injector 32 for hydraulic delay interval (HD) which is controlled to substantially correspond with the characteristic ignition delay (ID) of the engine 10.

This interval HD is depicted in FIG. 5 as extending from time $t_2$ until $t_3$ and it is determined by the length L of conduit 30 between pump 12 and conduit node $30_a$. This delay interval HD, is determined principally by the time it takes the pressure pulse generated by the abrupt closing of bypass valve 34 to travel the length L of conduit 30 from node $30_a$ to the pump 12 and back again. It will be appreciated that the length of conduit extension 30' will not affect the length of the interval HD. The length of conduit extension 30' does not affect the interval HD because the initial pressure pulse is also moving toward pump 30 while it is moving along extension 30'. Thus, if a particular type or class of engine 10 is tested and seen to have a characteristic ignition delay ID of approximately 1 millisecond, it will be desirable that the hydraulic delay interval HD from $t_2$ to $t_3$ of FIG. 5 is also appriximately 1 millisecond. Typically the speed of such a pressure pulse within the liquid fuel medium and at the pressures present will tend to be in the range of 4,000 ft/sec± several hundred ft/sec. Accordingly, assuming a pulse velocity of approximately 4,000 ft/sec in conduit 30, the length L of that conduit 30 may be preselected to provide the hydraulic delay which corresponds with the requisite ignition delay. By using the basic equation for time, distance and velocity, which is:

$$T=D/V,$$

where

T=the time of travel,

V=velocity, and

D=distance traveled, the parameter T may be replaced with HD which represents the desired hydraulic delay and the parameter D may be replaced with 2L which represents twice the length of the conduit 30, or in other words the "round-trip distance" of a pulse which originates near the injector and travels to the pump and returns. Using the foregoing expression, the distance D should be about four feet and thus the conduit length L should be about two feet.

Each conduit 30 should have the same length L. Apart from some relatively minor variations caused by variations in fuel density as a result of composition and pressure, the pulse velocity of 4,000 ft/sec may be considered a constant. On the other hand, characteristic ignition delays for differing types of engines may range from approximately 0.5 millisecond to slightly over 1 millisecond. Thus, in the instance of a desired 0.5 millisecond ignition delay, the length L will need to be approximately one foot. It will be appreciated that the shorter the length L is required to be, the closer the pump 12 will need to be to the several injectors 32 such that the length L of the conduits 30 to each respective injector need not exceed approximately one foot. Conversely, if the conduit length L is required to be relatively long, it may be accommodated by a curved or serpentine patterning of the conduit.

Returning to an analysis of the fuel pressure at injector 32 as illustrated in FIG. 5, it will be observed at time $t_3$, following the hydraulic delay, that the return of the reflected pressure pulse coupled with the rapidly increasing compression afforded by the pumping plunger 64, results in a significant secondary increase in the fuel pressure. This secondary increase in fuel pressure is relatively rapid and large, such that the fuel pressure at the injector 32 increases from about 4,000 or 5,000 psi to about 12,000 or 13,000 psi. While the initial phase of the fuel delivery may be characterized as providing a pilot fuel pulse starting at time $t_2$, this secondary stage serves to provide the main fuel pulse which supports most of the combustion occuring in the engine. The pilot fuel pulse will have mixed with the air in the engine and increased to an ignition or near-ignition temperature and the immediate follow-on of the main fuel pulse serves to optimize the fuel combustion process. Most of the fuel is injected during the main fuel pulse, with only about 25–35% being injected during the pilot phase.

The main fuel pulse is terminated by reopening the bypass valve 34 at time $t_4$ whereupon, following the brief interval required to transit conduit extensions 30'' and 30', the fuel pressure at the injector 32 rapidly drops below the closing threshold, $th_c$, of about 3,000 psi at time $t_5$ and injection is terminated. It will be noted that the pressure at pumping chamber 62 drops off rapidly also, but is delayed slighly as a result of the length of the conduit 30.

Clearly, if the main fuel pulse is to start at a time $t_3$ which has some predetermined correlation with a particular crank angle or cam angle, the closure of valve 34 will need to be timed such that $t_2$ occurs at the predetermined hydraulic interval HD prior to that desired instant for $t_3$. This hydraulic delay HD is determined by length L of conduit 30, and the desired time for $t_1$ is determinable and is substantially constant relative to $t_3$. Of course, the crank or cam angles of these times will vary with speed.

In accordance, with the invention, it is desirable that the bypass valve 34 be capable of closing its valve element 40 as rapidly as possible so as to effect the rapid presure rise between $t_1$ and $t_2$ seen in FIG. 5. It is also desirable that value 34 be capable of rapidly opening its valve element 40 to abruptly terminate fuel injection. Moreover, it is preferable that the bypass valve 34 and the injector 32 be positioned as close to one another as possible to simplify the fluid dynamics of the system. The particular solenoid-actuated, pressure-assisted bypass valve 34 illustrated in FIGS. 3 and 4 in integral combination with the injector 32 is particularly suited to this end.

Referring to FIG. 3, the high pressure conduit 30 is operatively connected to the injector nozzle body 52 in which is located node $30_a$ and from which extends conduit branch 30' to the injector chamber 58 and conduit branch 30'' extending toward the bypass valve 34. Conduit extension 30'' extends upwardly in valve body 52 to an opening positioned centrally in the upper surface 74 of the nozzle body. The solenoid-actuated bypass valve assembly 34 is positioned immediately above nozzle body 52 and is integrally joined therewith, as by a pair of hold-down bolts extending through a flange in valve cover 76 and into threaded engagement with a corresponding flange on the valve body 52. The active elements of the bypass valve are located in a housing cavity formed between the spaced, axially-opposing faces of valve cover 76 and nozzle body 52 and radially within a cylindrical collar 77 whose opposite ends extend around the valve cover 76 and the upper end of nozzle body 52 respectively.

A rod-like or spindle-like valve seat member 37 extends axially between the upper surface 74 of the nozzle body 52 and the cover 76. Valve seat 37 includes an upwardly-extending blind bore which defines at least part of inlet port 36. The valve seat 37 is positioned such that the bore or port 36 is aligned with the upper end of conduit 30''. The lower end of valve seat 36 is urged into substantially fluid sealing engagement with the upper surface 74 of nozzle body 52 by means of one or more Belleville washers 78 acting downwardly upon a surface of shoulder of valve seat 37 and upwardly upon the undersurface of cover 76. The concentric positioning of the valve seat 37 and the retention of the Belleville washer 78 on that valve seat may be assured by a pilot pin 79 extending from the upper end of the valve seats and into a centered bore in the undersurface of cover 76. Belleville washers 78 typically apply a 200–300 pound downward force on valve seat 37 to maintain it in substantially fixed sealing engagement with the upper surface 74 of the injector body 52.

The valve seat spindle 37 has a constant diameter over most of its lower extent and includes a region of larger diameter thereabove. In the region of larger diameter there is formed an annular control edge 80 whose diameter is greater than that of the lower spindle portion of the valve seat 37. An annular recess 81 is machined in the valve seat 37 immediately below the control edge 80 both to form that control edge and to provide a small high pressure plenum 81' adjacent to the valve seat. One or more radial bores 36' extend inwardly from the recess 81 to the axial port bore 36 to provide liquid communication between the port 36 and the plenum formed by the recess.

In the solenoid-actuated valve 34, the moving valve element is a valve sleeve 140 comprised of a cylindrical sleeve disposed about the lower portion of valve seat 37 and sized for close axial sliding relation therewith. The inner diameter of the valve sleeve 140 is, for most of its length, only slightly larger than the outside diameter of the lower portion of the valve seat 37 and somewhat less than the diameter of the control edge 80 of the valve seat 37. On the other hand, the outside diameter of the valve sleeve 140 is greater than the diameter of the control edge 80, and the transition from the inside diameter to the outside diameter near the upper end includes an upwardly inclined or inverted frustoconical surface 82 for contacting the control edge 80 when the valve is closed. Part of the inner surface of sleeve 140 and some of surface 82, cooperate with recess 81 in seat spindle 237 to define the plenum 81'. An annular armature 42 is joined to the valve sleeve 40 near its lower end, as through threaded engagement or preferably by means of a snap ring 83 received in a recess in the sleeve 140 and retaining the armature in fixed engagement with a shoulder of that sleeve. A plurality of bleed holes 84 extend axially through the armature 42 to minimize fluid resistance during actuation.

An annular stator structure 85 which includes the solenoid coil 44 as an integral part thereof, surrounds and is outwardly spaced from the valve sleeve 140. Stator 85 is positioned against the undersurface of cover 76 and is maintained in predetermined spaced relation with the upper surface 74 of the injector body 52 by means of an annular spacer 87. The leads from the coil 44 extend to a pair of terminals, here represented by a single terminal 45.

Figure 4:
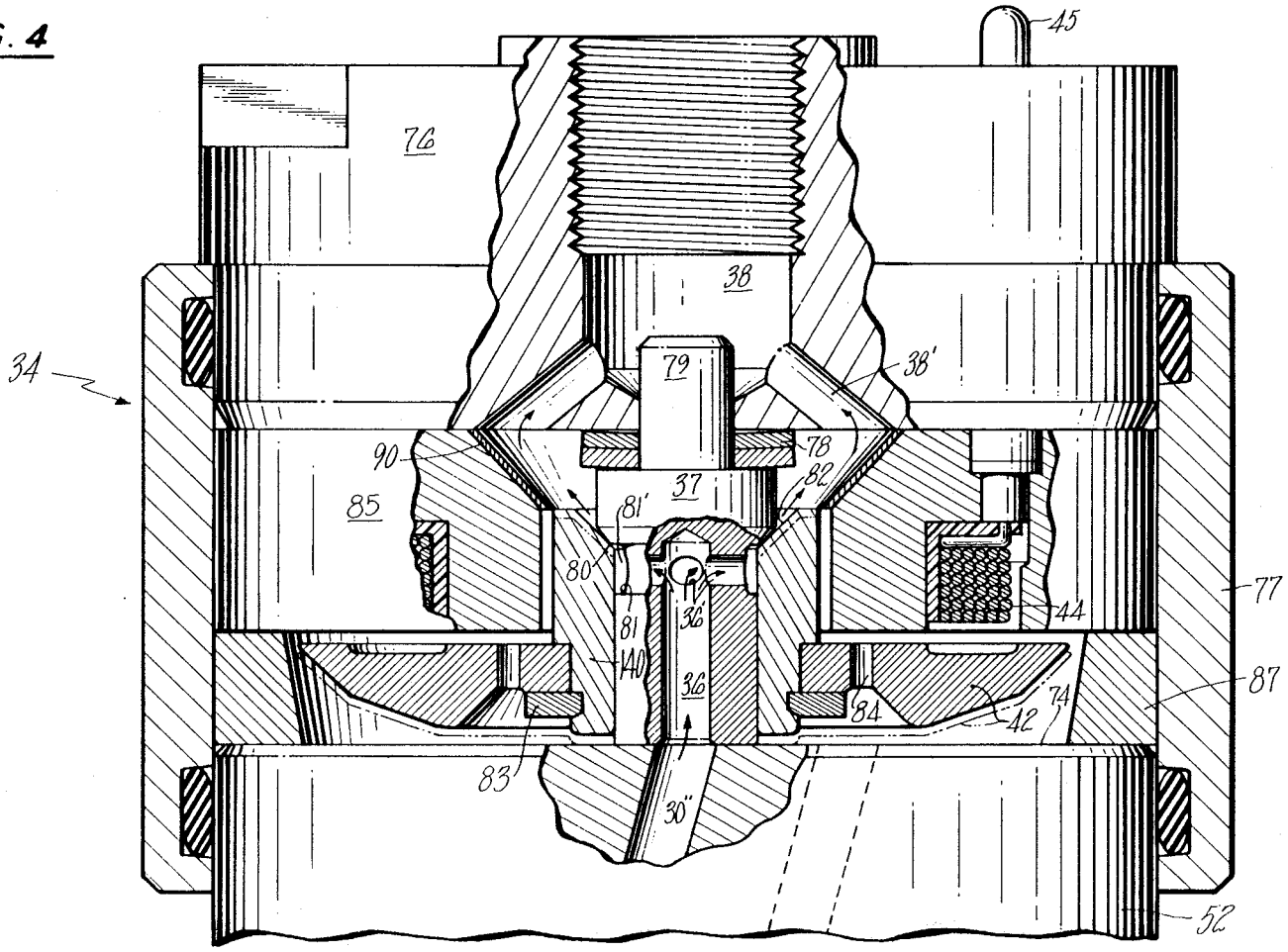
FIG. 4 is an enlarged partial view of FIG. 3 showing the solenoid actuated bypass valve in greater detail.

The amplitude of the stroke of valve sleeve 140 is determined by the contact of its surface 82 with the control edge 80 in the valve-closed position illustrated, and by contact of the lower end of the sleeve with the upper surface 74 of the injector body 52 in the full-open position illustrated in broken line in FIG. 4. That stroke or displacement of valve sleeve 140 may be closely controlled by the axial dimensioning of sleeve 140 and the selection of the angle of face 82 thereon. In the illustrated embodiment, that stroke is about 0.006 inch. Similarly, the axial positioning of the armature 42 on the valve sleeve 140 is preselected such that when the coil 44 is energized and the valve is closed as shown in FIG. 4, there remains a small air gap of approximately 0.004 inch between the armature and the stator 85. The stroke length of valve sleeve 140 determines the air gap spacing when the valve is fully open and, in the present instance, that air gap spacing is about 0.01 inch. Accordingly, adjustment of the open and closed air gap spacings may be controlled by adjustment of the valve sleeve stroke length and/or the positioning of the armature 42 on the valve sleeve 140 and/or the height of spacer 87.

A radially inner, upper surface of the stator 85 is conically beveled and includes a truncated conical spill deflector 90 of relatively hard metal to protect the stator. The region above the spill deflector 90 and below the undersurface of the valve cover 76 defines a low pressure plenum which communicates, via one or more angled bores 38' in the cover, with a large central bore 38 which defines the low pressure drain port associated with the valve.

Referring now to the operation of the solenoid valve assembly 34, although the valve is normally open, it has been illustrated in FIGS. 3 and 4 in its closed position. Assuming the valve sleeve 140 to be in its normally open position in which its lower end contacts surface 74 of injector body 52, a resulting gap or control orifice will exist between the control edge 80 and the surface 82 of the sleeve 140 through which fuel is free to pass in either direction depending upon pressure differences. For instance, if the fuel pressure in conduit 30'' is relatively high, as during a pumping stroke from pump 12, the open valve will serve to bypass fuel in the forward direction and exhaust it through drain port 38 to branch conduit 23 and thence to low pressure conduit 22. On the other hand, if the pump plunger is on its down stroke and is filling the pumping chamber, fuel may flow in the reverse direction by entering port 38 and exiting port 36.

When coil 44 is energized, the resulting electromagnetic forces cause armature 42 to be rapidly drawn upwardly until surface 82 of valve sleeve 140 contacts the control edge 80 of valve seat 37, thereby preventing fuel flow in either direction past the valve. So long as coil 44 remains energized, the valve will remain in this closed position illustrated in FIGS. 3 and 4.

Once the energizing signal is removed from coil 44, two forces act to rapidly open valve sleeve 140. Principally, assuming the pressure in conduit 30'' to be significantly greater than that in the region of port 38, the resulting hydraulic forces operate to open the valve. Secondarily, the valve seat spindle 37 and the valve sleeve 140 are preferably oriented vertically such that the force of gravity aids in opening the valve. Typically, at the instant it is desired to open the valve 34 the fuel pressure in conduit 30'' will be on the order of several thousand psi, whereas the fuel pressure at port 38 will be less than 100 psi. The resulting differential in pressure will act axially downwardly on that narrow annular portion of the valve sleeve 140 which extends radially outward from the inner diameter of that valve sleeve to its point of contact with the control edge 80 of the valve seat 37. The remainder of the valve sleeve 140 and armature 42 radially outward of the control orifice between edge 80 and surface 82 is in a "low" pressure region of equalized force in both the opening and closing directions. In the illustrated embodiment, the side diameter of the valve sleeve 140 is 0.236 inch and the diameter of the control edge 80 is 0.252 inch.

It is desirable that the valve sleeve 140 remains in its full-open position until the next closing signal is applied to the solenoid coil 44 in order to ensure a predictable and uniform interval from the instant of the signal until the valve is closed. A component of engine vibration axially of valve sleeve 140 could be capable of causing oscillation or "chatter" of sleeve 140, particularly during the low pressure phase of the pumping cycle, unless some bias force is maintained in the "valve opening" direction. The effect of gravity is not particularly significant and accordingly, a hydraulic bias of one pound or more of force is employed. Specifically, although most of the axially-facing areas of valve sleeve 140 and armature 42 are pressure-balanced in the axial direction, care is taken to provide some portion of the valve sleeve 140 and/or armature 42 which receives a net "opening" hydraulic bias while the valve is open. This is accomplished in the present embodiment by the axially-facing area at the bottom end of valve sleeve 140 being smooth and in full, liquid-excluding contact with smooth surface 74 of injector body 52. The resulting hydraulic force serving to bias valve sleeve 140 to the open position will then be the product of the low supply pressure, i.e., 25–50 psi, and the unbalanced area, i.e., about 0.066 square inch. The resulting force is in excess of one pound and substantially eliminates unwanted valve oscillations.

A solenoid valve assembly possessing the aforementioned characteristics is capable of being actuated from its normally open to its closed position in 1 millisecod or less and conversely, the valve is capable of being actuated from its fully closed to its fully opened position in 1 millisecond or less. In each instance there is no requirement for mechanical biasing means to aid or control the movement of the valve sleeve 140.

Although this invention has been shown and described with respect to detailed embodiments thereof, it will be understood by those skilled in the art that various changes in form and detail thereof may be made without departing from the spirit and scope of the claimed invention.

Having thus described a typical embodiment of my invention, that which is claimed as new and desired to secure by Letters Patent of the United Stated is:

1. A system for controlling delivery of fuel from a fuel source to a compression-ignition engine having at least one cylinder provided with a respective fuel injector, said engine having a predetermined characteristic ignition delay time and said fuel injector being biased to a normally-closed position, comprising:

positive-displacement pump means for receiving fuel from said source and providing intermittent, pressurized pulses of fuel flow;

first conduit means of a preselected length extending from said pump means to a node, said fuel injector being operatively connected to said first conduit means at said node;

bypass control valve means responsive to an electrical control signal for moving rapidly between open and closed positions, said valve means having a first port operatively connected to said first conduit means at said node and having a second port connected to a region of relatively low pressure, said control valve being normally open to permit the pulsed fuel to flow from said pump means to said low pressure region thereby bypassing said injector;

closure of said control valve diverting said pulsed flow to said injector to cause a rapid pressure rise at the injector to a first level sufficient to initiate a pilot injection, said control valve closure creating a pressure wave in said first conduit means traveling from said node toward said pump means, said pressure wave being reflected at said pump means back to said node to effect a consequent rapid pressure increase at said injector to a second level greater than said first level and thereby effecting the main fuel injection;

said first conduit means having a length preselected so as to return said pressure wave to said injector at a predtermined time following the initiation of pilot injection to provide a hydraulic delay between initiation of pilot injection and main injection, said hydraulic delay being substantially equal to the engine ignition delay time.

2. The invention as claimed in claim 1, wherein the length of said first conduit means is substantially as defined by the equation:

$$L=\tfrac{1}{2}(ID)\,(V)$$

wherein:

L=length of said first conduit means

ID=engine ignition delay time

V=velocity of said pressure wave.

3. The fuel control system fo claim 1 wherein said injector and said bypass control valve means are each connected to said first conduit means at said node by respective extension conduit means, each said extension conduit means being relatively short in comparison to the length of said first conduit means.

4. The fuel control system of claim 1 including second conduit means operatively connected to said second port of said control valve means and wherein said bypass control valve means is normally open and said pump means receives at least part of said fuel from said source via reverse flow in said second and said first conduits.

5. The fuel control system of claim 1 wherein said bypass control valve means is normally open and is actuated to its closed position during respective said pulses of fuel flow.

6. The fuel control system of claim 5 wherein said bypass control valve means is reopened before completion of the respective pulse of fuel flow during which it was closed.

7. The fuel control system of claim 6 wherein the initiation and duration of each said pressurized pulse of fuel from said pump means, referenced to the engine crank angle, is substantially constant for all operating conditions of the engine.

8. The fuel control system of claim 7 wherein the timing of at least said opening or said closing of said bypass control valve means is adjustable during operation.

9. The fuel control system of claim 1 wherein said engine includes a plurality of cylinders, each said cylinder having a respective said fuel injector, each said fuel injector being supplied with fuel via a respective separate said first conduit means, each said first conduit means having substantially the same length, each said first conduit means having a respective separate said bypass control valve means associated therewith and wherein said pump means includes means for delivering said pulses of fuel flow to respective said first conduit means in a predetermined sequence.

10. The fuel control system of claim 9 wherein said pump means is an in-line pump having a plurality of pumping cylinders, each said pumping cylinder corresponding with a respective one of said fuel injectors.

11. The fuel control system of claim 9 wherein said fuel is directly injected into a respective cylinder of said engine by a respective injector, and said pump is of a high pressure type capable of providing fuel pressures of at least about 10,000 psi.

12. The fuel control system of claim 9 wherein a said bypass control valve means is included as an integral part of a said injector in a common housing.

13. The fuel control system of claim 12 wherein said bypass control valve means includes a normally open valve and an electromagnetic actuator responsive to said electrical control signal for moving the valve from its open position to its closed position in less than one millisecond.

14. The fuel control system of claim 13 wherein said valve of said bypass control valve means is moved from its closed position to its open position by an opening force in less than one millisecond upon completion of said electrical control signal, said opening force being provided by the pressure of said fuel and independently of mechanical biasing forces.

* * * * *